US005166738A

United States Patent [19]

Tani

[11] Patent Number: 5,166,738

[45] Date of Patent: Nov. 24, 1992

[54] COPIER OPERABLE IN TWO-SIDED AND COMBINATION COPY MODES

[75] Inventor: Tatsuo Tani, Urayasu, Japan

[73] Assignee: Ricoh Company, Ltd., Tokyo, Japan

[21] Appl. No.: 712,560

[22] Filed: Jun. 10, 1991

[30] Foreign Application Priority Data

Aug. 11, 1990 [JP] Japan ..... 2-212286

[51] Int. Cl.[5] ..... G13G 21/00

[52] U.S. Cl. ..... 355/319; 271/3.1; 271/291; 271/301; 355/313; 355/321

[58] Field of Search ..... 355/313, 318, 319, 321; 271/3.1, 291, 301

[56] References Cited

U.S. PATENT DOCUMENTS

| | | | |
|---|---|---|---|
| 4,734,738 | 3/1988 | Yamanaka et al. | 355/318 |
| 4,835,567 | 5/1989 | Ogata | 355/318 |
| 4,849,786 | 7/1989 | Murakami | 355/319 X |
| 4,943,832 | 7/1990 | Emori | 355/313 |
| 4,967,240 | 10/1990 | Kitano et al. | 355/318 |
| 5,026,037 | 6/1991 | Masuda | 271/3.1 |

*Primary Examiner*—A. T. Grimley
*Assistant Examiner*—P. Stanzione
*Attorney, Agent, or Firm*—Oblon, Spivak, McClelland, Maier & Neustadt

[57] ABSTRACT

A copier operable in a two-sided copy mode and a combination copy mode. The copier effects both of the two different copy modes without resorting to a plurality of intermediate trays and by allowing a minimum of local contamination due to a toner to occur on copy sheets.

11 Claims, 12 Drawing Sheets

COPIER OPERABLE IN TWO-SIDED AND COMBINATION COPY MODES

BACKGROUND OF THE INVENTION

The present invention relates to a copier operable in a two-sided copy mode and a combination copy mode, as desired.

A copier capable of producing a two-sided copy carrying an image on both sides thereof, a copier capable of producing a combination copy carrying a plurality of combined images on one side thereof, and a copier having both of such capabilities are extensively used today. It is a common practice with this kind of copier to use an intermediate tray for temporarily stacking copy sheets each carrying an image on one side thereof. A feed roller refeeds such copy sheets one by one from the intermediate tray to an image transfer station where a photoconductive element is located. The copy sheets are stacked on the intermediate tray face up or face down, as the case may be. Usually, the copy sheets are stacked face up in a two-sided copy mode and face down in a combination copy mode. It has been customary to refeed the lowermost copy sheet first or the uppermost copy sheet first at all times when the feed roller is so configured. Such a scheme has some problems left unsolved, as follows. Assume that the copy sheets are stacked on the intermediate tray face down, i.e., with their sides carrying toner images facing downward. When the uppermost copy sheet is refed while sliding on the underlying copy sheet, the former has its image portion strongly rubbed against a portion of the latter which corresponds to the feed roller. As a result, a small amount of toner comes off the image surface of the copy sheet and rubbed against the portion of interest of the copy sheet, smearing the the copy sheet.

On the other hand, assume that the copy sheets are stacked on the intermediate tray face up, i.e., with their sides carrying the toner images facing upward. Then, the image in the portion of the underlying copy sheet corresponding to the feed roller rubs against the overlying copy sheet. Nevertheless, it is not that the image in the portion of interest of the copy sheet rubs itself against the same portion of the overlying copy sheet, but that the former rubs against the leading edge to the trailing edge of the latter, i.e., over the entire length of the latter. Hence, despite that some toner comes off the copy sheet and deposits on the copy sheet, it is scattered over the surface of the copy sheet and, therefore, does not noticeably contaminate the copy sheet.

For the same reason, when the copy sheets are stacked on the intermediate tray face up and the lowermost one of them is refed first, the toner smears the copy sheets. However, when the lowermost one of the copy sheets stacked face down on the tray is fed first, no noticeable contamination occurs.

As stated above, the copy sheets are smeared or not smeared, depending on the orientation of the image surfaces of the copy sheets and which of the copy sheets is refed first. To eliminate the contamination by the toner, it is preferable that the copy sheets be stacked on the intermediate tray face up and then refed therefrom, the uppermost copy sheet being first. However, although such a manner of refeed is feasible for a two-sided copy mode, it is not practicable when it comes to a combination copy mode. Specifically, in a combination copy mode, should such a refeed principle be used, the surface of each copy sheet opposite to the surface which carries an image and should meet another image to be combined at an image transfer station would meet the image of interest. It has been customary, therefore, to use two different intermediate trays, i.e., one for feeding the uppermost one of copy sheets stacked face up first, and the other for feeding the lowermost one of copy sheets stacked face down first. The first-mentioned intermediate tray is assigned to a two-sided copy mode while the second-mentioned intermediate tray is assigned to a combination copy mode. This kind of implementation is disclosed in, for example, Japanese Patent Laid-Open Publication No. 206742/1986. Although such an implementation successfully deals with both of a two-sided copy mode and a combination copy mode and prevents copy sheets from being smeared, it increases the overall dimensions and cost of the copier due to the two intermediate trays.

SUMMARY OF THE INVENTION

It is therefore an object of the present invention to provide a copier operable in a two-sided copy mode and a combination copy mode without resorting to a plurality of intermediate trays and eliminating local contamination by a toner.

It is another object of the present invention to provide a generally improved copier operable in a two-sided copy mode and a combination copy mode.

In accordance with the present invention, a copier operable in a two-sided copy mode and a combination copy mode comprises an intermediate tray for stacking copy sheets sequentially moved away from an image forming station, a feeding device for feeding the copy sheets one by one from the intermediate tray by frictionally contacting the image side of each copy sheet which carries an image thereon, and a transporting device for transporting each copy sheet fed by the feeding device such that in a two-sided copy mode the side of the copy sheet opposite to the image side faces the image forming station while, in a combination copy mode, the image side faces the image forming station.

Also, in accordance with the present invention, a copier operable in a two-sided copy mode and a combination copy mode comprises an intermediate tray for stacking copy sheets sequentially moved away from an image foming station and each being positioned such that the image side thereof which carries an image faces downward, a feeding device for feeding the copy sheets one by one from the intermediate tray, the lowermost copy sheet being first, a reversing device for turning over each copy sheet fed by the feeding device and then driving the copy sheet toward the image forming station, and a path selecting device for guiding each copy sheet to the reversing device in a two-sided copy mode or directly to the image forming station in a combination copy mode.

Further, in accordance with the present invention, a copier operable in a two-sided copy mode and a combination copy mode comprises a first reversing device for turning over each copy sheet moved away from an image forming station, an intermediate tray for stacking such copy sheets moved away from the first reversing device and each being positioned such that the image side thereof which carries an image faces downward, a feeding device for sequentially feeding the copy sheets stacked on the intermediate tray, the lowermost copy sheet being first, a second reversing device for turning over each copy sheet fed by the feeding device and then driving the copy sheet toward the image forming station, and a path selecting device for guiding, in a two-sided copy mode, each copy sheet toward the image forming station via the second reversing device such that the side of the copy sheet opposite to the image side faces the image forming station or guiding, in a combination copy mode, the copy sheet directly toward the image forming station without the intermediary of the second reversing device such that the image side of the copy sheet faces the image forming station.

Moreover, in accordance with the present invention, a copier operable in a two-sided copy mode and a combination copy mode comprises an intermediate tray for stacking copy sheets sequentially moved away from an image forming station and each being positioned such that the image side thereof which carries an image faces downward, a feeding device for sequentially feeding the copy sheets stacked on the intermediate tray, the uppermost copy sheet being first, a reversing device for turning over each copy sheet fed by the feeding device and then driving the copy sheet toward the image forming station, and a path selecting device for guiding, in a two-sided copy mode, the copy sheets toward the image forming station via the reversing device such that the side of each copy sheet opposite to the image side faces the image forming station or guiding, in a combination copy mode, the copy sheets directly to the image forming station without the intermediary of the reversing device such that the image side faces the image forming station.

In addition, in accordance with the present invention, a copier operable in a two-sided copy mode and a combination copy mode comprises a first reversing device for turning over copy sheets sequentially moved away from an image forming station, an intermediate tray for stacking the copy sheets moved away from the first reversing device and each being positioned such that the image side thereof which carries an image faces upward, a feeding device for sequentially feeding the copy sheets stacked on the intermediate tray, the uppermost copy sheet being first, a second reversing device for turning over each copy sheet fed by the feeding device and then driving the copy sheet toward the image forming station, and a path selecting device for guiding, in a two-sided copy mode, each copy sheet toward the image forming station via the second reversing device such that the side of the copy sheet opposite to the image side faces the image forming station or guiding, in a combination copy mode, the copy sheet directly toward the image forming station without the intermediary of the second reversing means such that the image side faces the image forming station.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 14:
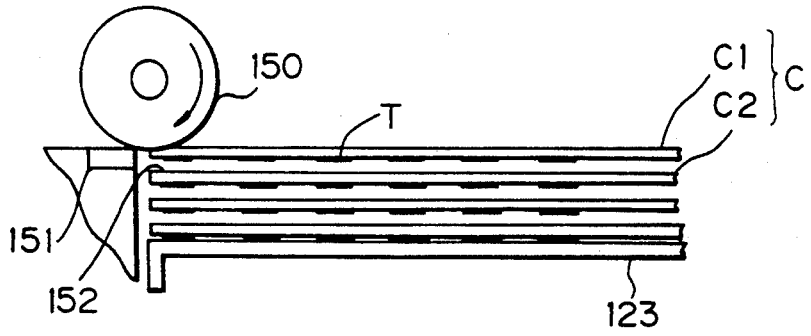
Fig. 14 PRIOR ART
FIG. 14 is a side elevation of a conventional intermediate tray.

To better understand the present invention, a brief reference will be made to a prior art copier of the type to which the present invention pertains. FIG. 14 shows an intermediate paper feeding section included in the conventional copier. As shown, an intermediate tray 123 is loaded with a stack of copy sheets C while a feed roller 150 is pressed against the uppermost sheet C1 of the stack. The feed roller 150 and a friction pad 151 constitute a paper feeding device. The feed roller 150 is rotated clockwise, as viewed in the figure, so as to refeed the copy sheets C one by one from the intermediate tray 123, the uppermost sheet C1 being first.

Figure 15:
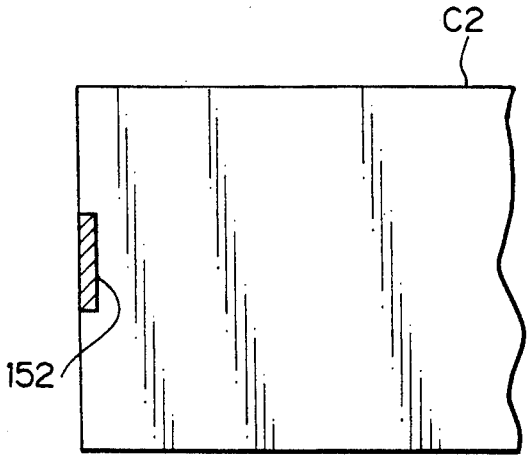
Fig. 15 PRIOR ART
FIG. 15 is a plan view showing a copier locally smeared by a toner.

Assume that the copy sheets C are stacked on the intermediate tray 123 face down, i.e., with their sides carrying toner images T facing downward. When the uppermost copy sheet C1 is refed while sliding on the underlying copy sheet C2, the former has its image portion strongly rubbed against a portion 152 of the latter which corresponds to the feed roller 150. As a result, as shown in FIG. 15, a small amount of toner comes off the image surface of the copy sheet C1 and rubbed against the portion 152 of the copy sheet C2, smearing the copy sheet C2.

Figure 16:
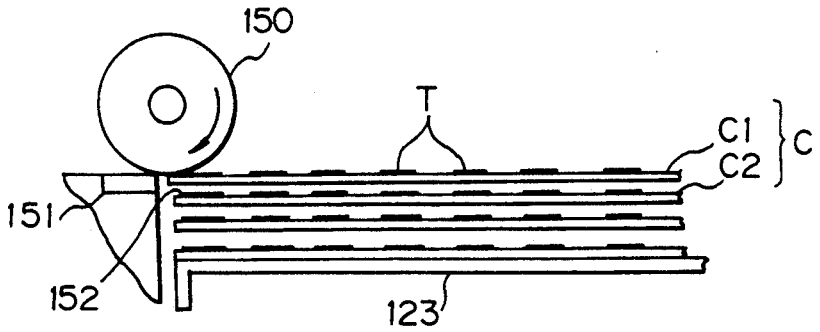
Fig. 16 PRIOR ART
FIG. 16 is a side elevation of the conventional intermediate tray on which copy sheets are stacked in the opposite position to the position shown in FIG. 14.

On the other hand, as shown in FIG. 16, assume that the copy sheets C are stacked on the intermediate tray 123 face up, i.e., with their sides carrying the toner images facing upward. Then, the image in the portion 152 of the underlying copy sheet C2 corresponding to the feed roller 150 rubs itself against the overlying copy sheet C1. Nevertheless, it is not that the image in the portion 152 of the copy sheet C2 rubs itself against the same portion of the overlying copy sheet C1, but that the former rubs against the leading edge to the trailing edge of the latter, i.e., over the entire length of the latter. Hence, despite that some toner comes off the copy sheet C2 and deposits on the copy sheet C1, it is scattered over the surface of the copy sheet C1 and, therefore, does not noticeably contaminate the copy sheet C1.

For the same reason, when the copy sheets C are stacked on the intermediate tray 123 face up and the lowermost one of them is refed first, the toner smears the copy sheets, as shown in FIG. 14. However, when the lowermost one of the copy sheets C stacked face down on the tray 123 is fed first, no noticeable contamination occurs, as shown in FIG. 16.

As stated above, the copy sheets C are smeared or not smeared, depending on the orientation of the image side of the copy sheets C and which of the copy sheets C is refed first. To eliminate the contamination by the toner, it is preferable that the copy sheets C be refed in the manner shown in FIG. 16. However, although such a manner of refeed is feasible for a two-sided copy mode, it is not practicable when it comes to a combination copy mode. Specifically, in a combination copy mode, should the refeed principle shown in FIG. 16 be used, the side of each copy sheet C opposite to the image sie which carries an image and should meet another image to be combined at an image transfer station would meet the image of interest. It has been customary, therefore, to use two different intermediate trays, i.e., one for feeding the uppermost one of copy sheets stacked face up first, as shown in FIG. 16, and the other for feeding the lowermost one of copy sheets stacked face down first. The first-mentioned intermediate tray is assigned to a two-sided copy mode while the second-mentioned intermediate tray is assigned to a combination copy mode. This kind of implementation is disclosed in, for example, Japanese Patent Laid-Open Publication No. 206742/1986. Although such an implementation successfully deals with both of a two-sided copy mode and a combination copy mode and prevents copy sheets from being smeared, it increases the overall dimensions and cost of the copier due to the two intermediate trays.

Figure 1:
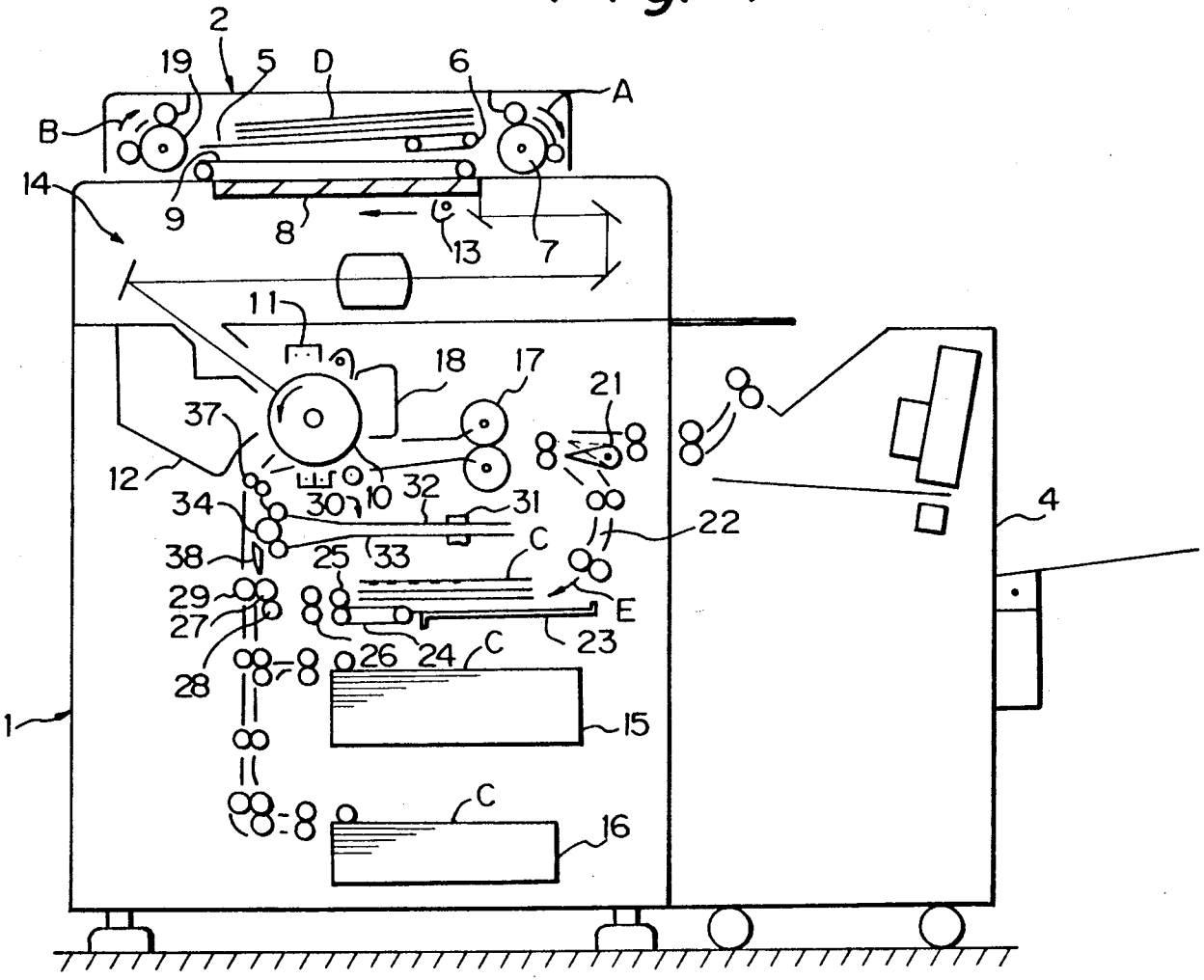
FIG. 1 is an elevation showing a first embodiment of the copier in accordance with the present invention.

Referring to FIG. 1, a first emodiment of the copier in accordance with the present invention is shown which is operable with a finisher 4 and/or an automatic document feeder (ADF) 2, as desired. As shown, the ADF 2 is mounted on the top of the body 1 of the copier and includes a tray 5 and a belt 6 located at the right-hand side of the tray 5. A stack of documents D is positioned on the tray 5 and belt 6. As the belt 6 is rotated, it feeds the lowermost one of the documents D to the right, as viewed in the figure. A roller 7 rotating clockwise conveys the document D fed by the belt 6, as indicated by an arrow A in the figure. A belt 9 is located to face a glass platen 8 which is affixed to the copier body 1. The belt 9 drives the document D onto the glass platen 8 and stops it at a predetermined position on the glass platen 8. At this instant, the document is positioned on the glass platen 8 face down.

A photoconductive drum 10 is mounted on the copier body 1 and rotatable counterclockwise. Arranged around the drum 10 are a charger 11, a developing unit 12, etc. Optics 14 including a light source 13 is disposed above the drum 10. The light source 13 is moved in a direction indicated by an arrow for scanning the glass platen which is laid on the glass platen 8. The resultant reflection from the document is propagated through the optics 14 to the surface of the drum 10 which has been charged by the charger 11. As a result, a latent image representative of the document is electrostatically formed on the drum 10. The developing unit 12 develops the latent image as the latter passes it, thereby producing a toner image. The toner image is transferred to one side (first side) of a copy sheet C having been fed from one a first and a second paper feeding device 15 and 16 to an image transfer station, i.e., an image forming station where the drum 10 is located. A fixing unit 17 fixes the toner image on the copy sheet C. A cleaning device 18 removes toner particles which remain on the drum 10 after such image transfer. After the document has been fully scanned by the light source 13, it is again driven by the belt 9 to the left toward a turn roller 19. The turn roller 19 transports the document therearound and thereby returns it to the tray 5, as indicated by an arrow B. As a result, the document is stacked on the other documents on the tray 5 face up.

A selector in the form of a pawl 21 is located at the right-hand side of the fixing unit 17. The selector 21 is brought to a position indicated by a solid line in the figure at such a timing that a copy sheet fully undergone any one of a one-sided copy mode, two-sided copy mode and combination copy mode is directed toward the finisher 4. When the copier is operated without the finisher 4, the copy sheets will be directly driven out onto a copy tray, not shown.

Figure 2:
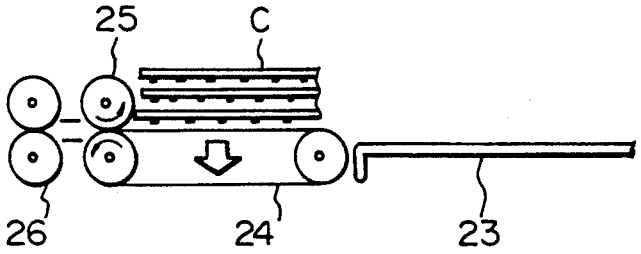
FIG. 2 is a side elevation of an intermediate tray included in the embodiment together with members associated therewith.

In a two-sided or a combination copy mode, the selector 21 is switched to a position indicated by a phantom when the first copying sequence is completed. In such a position, the selector 21 steers each copy sheet carrying an image on the first side thereof into a reversing path 22. Then, the copy sheet leaves the reversin path 22 in a direction indicated by an arrow E. An intermediate tray 23 is located downstream of the reversing path 22 with respect to the direction E. The copy sheets sequentially coming out of the path 22 are stacked on the intermediate tray 23 face down. As shown in FIG. 2, a feeding device including a belt 24 and a separation roller 25 adjoins the intermediate tray 23 and refeeds the copy sheets C stacked on the intermediate tray 23, the lowermost copy sheet C being first. More specifically, the belt 24 in rotation refeeds each copy sheet C by frictionally contacting the image side of the latter. As indicated by an arrow A in FIG. 2, air is sucked between the upper and lower runs of the belt 24 to retain the copy sheet C on the surface of the belt 24. The separation roller 25 is rotated in the opposite direction to the refeed direction to separate one of the copy sheets C from the others. Air may be blown onto the leading end of the copy sheets C to lift the entire copy sheets C. The copy sheet C so fed out by the feeding device is sequentially routed through a transport roller pair 26, transport rollers 27 and 28 and transport rollers 27 and 29.

Figure 3:
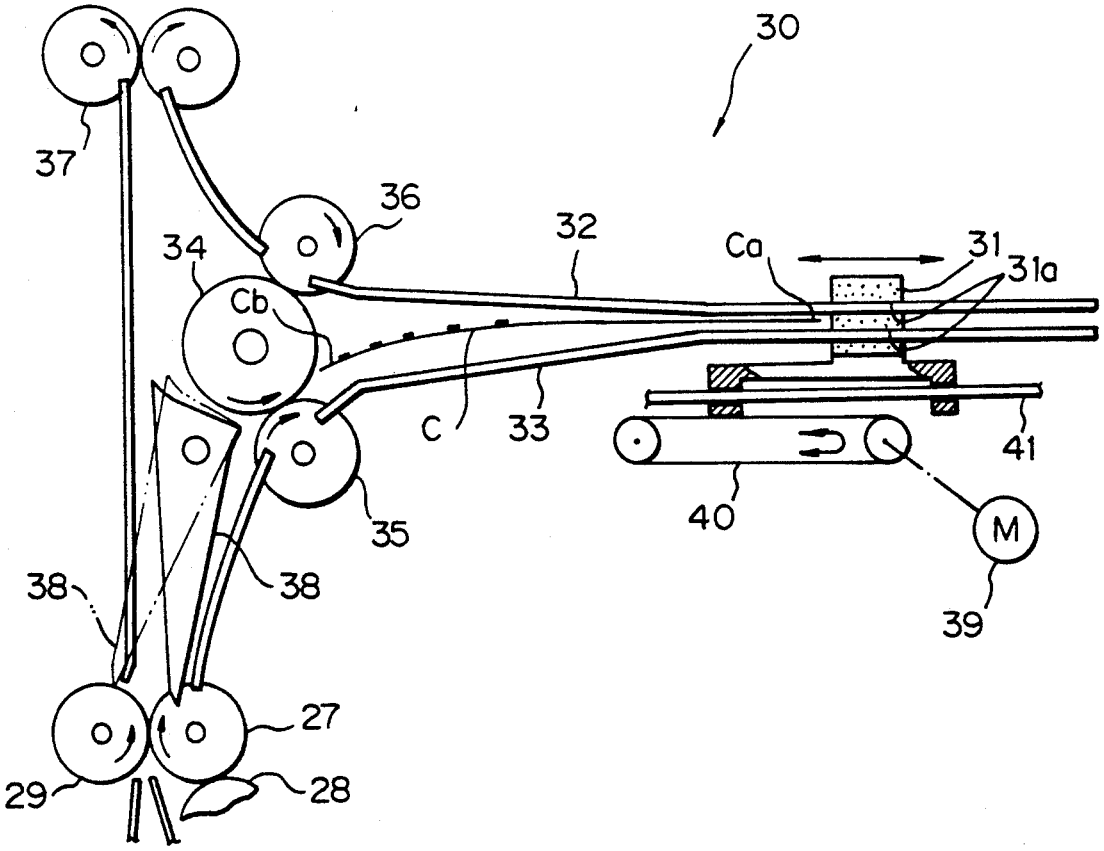
FIG. 3 is a side elevation of a reversing device also included in the embodiment.

As shown in FIG. 3, a sheet reversing device 30 is disposed above the feeding device and includes a stop 31, a pair of guides 32 and 33, a trailing edge drive roller 34, and transport rollers 35 and 36 contacting the roller 34. A path switching device implemented as a pawl 38 is located in the vicinity of and downstream of the transport rollers 27 and 29 with respect to the sheet transport direction.

In FIGS. 1 and 3, in a combination copy mode, the pawl 38 is held in a position indicated by a solid line and simply guides the copy sheet C coming out of the transport rollers 27 and 29 upward. Then, the copy sheet C is routed through the previously mentioned image transfer station and fixing device 17 to the finisher 4. Of course, the copy sheet C passes the image transfer station face up with the result that an image is transferred to the copy sheet C over an image already existing on the copy sheet C. On the other hand, in a two-sided copy mode, the pawl 38 is brought to a position indicated by a phantom line by a solenoid or similar actuating means, not shown. In this position, the pawl 38 steers the copy sheet C to between the trailing edge drive roller 34 and the transport roller 35. These rollers 34 and 35 drive the copy sheet C and then stops the copy sheet C when the leading edge Ca thereof abuts against the stop 31. When the leading edge Ca of the copy sheet C is stopped in such a position, the trailing edge Cb of the same has move away from the nip between the rollers 34 and 35 and contacted the periphery of the roller 34. Subsequently, as the roller 34 is rotated in a direction indicated by an arrow in the figure, the trailing edge Cb of the copy sheet C moves upward entrained by the surface of the roller 34. As a result, the trailing edge Cb is caught by the rollers 34 and 36. Then, the copy sheet C is moved upward toward a transport roller pair 37 with the trailing edge Cb thereof now serving as the leading edge. After the copy sheet C has been turned over by the above arrangement, an image is transferred to the other side (second side) of the copy sheet C, i.e., the two-sided copy mode operation is completed.

The copy sheet C fully undergone such a two-sided copy mode operation is driven out of the copier to the finisher 4 by way of the fixing device 17. The finisher 4 staples or otherwise finishes the copy sheets C sequentially coming out of the copier. Of course, copy sheets C undergone a combination copy mode operation may also be so finished.

As stated above, in a two-sided copy mode, the reversing device 30 turns over the copy sheet C so that the side of the copy sheet C opposite to the image side may face the drum 10 at the image transfer station. In a combination copy mode, the copy sheet C is transported to the image transfer station without being turned over, i.e., such that the side thereof carrying an image thereon again faces the drum 10. In any case, the copy sheets C are refed from a single intermediate tray 23 face down, the lowermost copy sheet being first. This allows a minimum of local contamination by the toner to occur (FIG. 15). Further, since an extra intermediate tray is not necessary, the overall size and cost of the copier are reduced.

The stop 31, FIG. 3, may be implemented by sponge. Then, when the leading edge Ca of the copy sheet C abuts against the stop 31, the trailing edge Cb of the same will strongly abut against the surface of the roller 34 due to the restoring force of the sponge and will be readily entrained by the roller 34. The roller 34 may also be formed of sponge or provided with a toothed surface to even more easily catch the trailing edge Cb of the copy sheet. C. The guides 32 and 33 have parallel portions which extend throughout two through bores 31*a* which are formed in the stop 31. When a drive belt 40 is reversibly driven by a motor 39, the stop 31 affixed to the belt 40 is moved in the horizontal direction while being guided by a guide rail 41. Specifically, the stop 31 is movable to accommodate copy sheets of various sizes usable with the copier.

When documents are sequentially copied in order of page and the resulted copies are sequentially refed from the intermediate tray 23 also in order of page, the finisher 4 can staple or otherwise finish each set of copies at a time. This is also true with alternative embodiments of the present invention which will be described.

Figure 4:
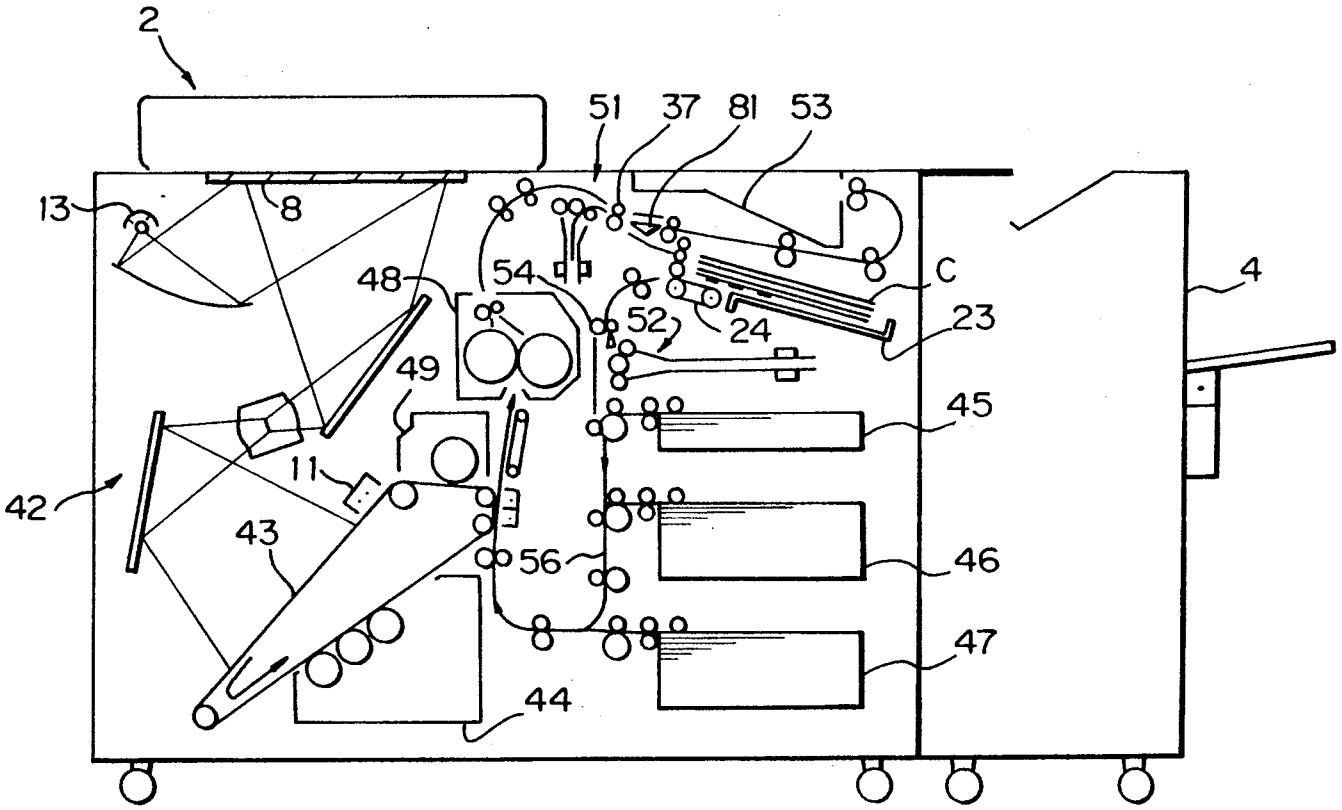
FIG. 4 is a view showing a second embodiment of the present invention.

Referring to FIG. 4, a second embodiment of the present invention will be described. As shown, the copier has optics 42 including a light source 13. The light source 13 illuminates a document, not shown, laid on a glass platen 8. The resultant reflection from the document is propagated through the optics 42 to reach the surface of a photoconductive belt 43 which has been charged by the charger 11 beforehand. As a result, a latent image representative of the document is electrostatically formed on the belt 43. A developing device 44 develops the latent image as the latter passes it, thereby producing a toner image. The toner image is transferred to one side of a copy sheet having been fed from any one of three paper feeding devices 45, 46 and 47 to an image transfer station, i.e., an image forming station where the belt 10 is located. A fixing device 48 fixes the toner image on the copy sheet. A cleaning device 49 removes toner particles which remain on the belt 43 after such image transfer. The copy sheet moved away from the fixing device 48 is transported toward a first reversing device 51, shown in FIG. 5. The first reversing device 51 is identical in construction with the reversing device 30 of FIG. 3 except that it is arranged in the vertical direction. Therefore, the component parts of the reversing device 51 are designated by the same reference numerals as those of the reversing device 30, and redundant description will be avoided for simplicity.

Figure 5:
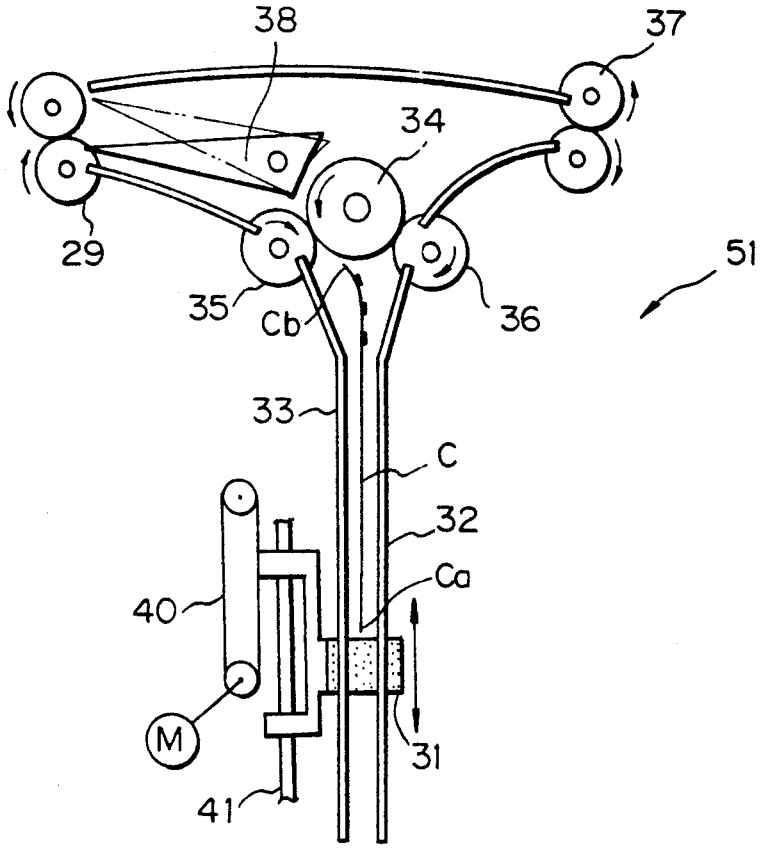
FIG. 5 is a view showing a first reversing device included in the second embodiment.

In FIGS. 4 and 5, a selector 38 is brought to a position indicated by a solid line in the figure at such a timing that a copy sheet C fully undergone any one of a one-sided copy mode, two-sided copy mode and combination copy mode is routed through a transport roller pair 37 to a tray 53. In a two-sided or a combination copy mode, the selector 38 is switched to a position indicated by a phantom line by a solenoid or similar actuating means, not shown. In this position, the pawl 38 steers the copy sheet C to between a trailing edge drive roller 34 and a transport roller 35. These rollers 34 and 35 drive the copy sheet C and then stops the copy sheet C when the leading edge Ca thereof abuts against a stop 31. When the leading edge Ca of the copy sheet C is stopped in such a position, the trailing edge Cb of the same has move away from the nip between the rollers 34 and 35 and contacted the periphery of the roller 34. Subsequently, as the roller 34 is rotated in a direction indicated by an arrow in the figure, the trailing edge Cb of the copy sheet C moves to the right entrained by the surface of the roller 34. As a result, the trailing edge Cb is caught by the the rollers 34 and 36.

Then, the copy sheet C is moved upward toward a transport roller pair 37 with the trailing edge Cb thereof now serving as the leading edge. Thereafter, the copy sheet C is guided by a selector or pawl 81 to the intermediate tray 23 and stacked thereon face down. The members such as the stop 31 shown in FIG. 5 have the same functions as those of the previous embodiment. The copy sheets stacked on the intermediate tray 23 are sequentially refed in order of page by the feeding device including the belt 24 and roller 25, FIG. 2, the lowermost copy sheet being first. In a two-sided copy mode, the copy sheet C refed from the tray 23 is transported toward a second reversing device 52 shown in FIG. 6 by way a transport roller pair 54. A path selecting device implemented as a pawl 55 is located below the transport roller pair 54.

Figure 6:
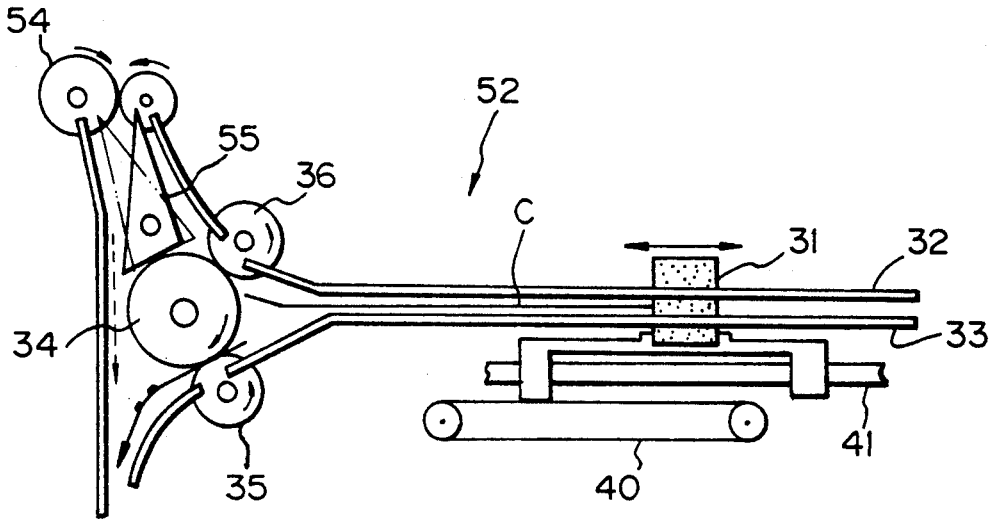
FIG. 6 is a view of a second reversing device also included in the second embodiment.

In a two-sided copy mode, the pawl or selector 55 is held in a position indicated by a phantom line in FIG. 6. In this condition, the copy sheet C is guided by the selector 55 to between the rollers 34 and 36 and then driven in a reversed position in a direction indicated by a solid line via the rollers 34 and 35. Subsequently, the copy sheet C is transported to the image transfer station via a transport path 56 shown in FIG. 4, whereby another toner image is transferred from the belt 43 to the other side of the copy sheet C. Finally, the copy sheet or two-sided copy C is driven out to a tray 53 by way of the fixing device 48. On the other hand, in a combination copy mode, the selector 55 is switched to a position indicated by a solid line in FIG. 6. Then, the copy sheet refed from the intermediate tray, FIG. 4, is directly transported toward the transport path 56, FIG. 4, without the intermediary of the second reversing device 52, as indicated by a dotted arrow in FIG. 6. As a result, another toner image is transferred to the same side of the copy sheet C. The resultant copy carrying combined images on one side thereof is discharged to the tray 53 via the fixing device 48.

This embodiment is also successful in reducing local contamination ascribable to the toner since the copy sheets C are refed from the intermediate tray 23 face down, the lowermost copy sheet being first.

Figure 7:
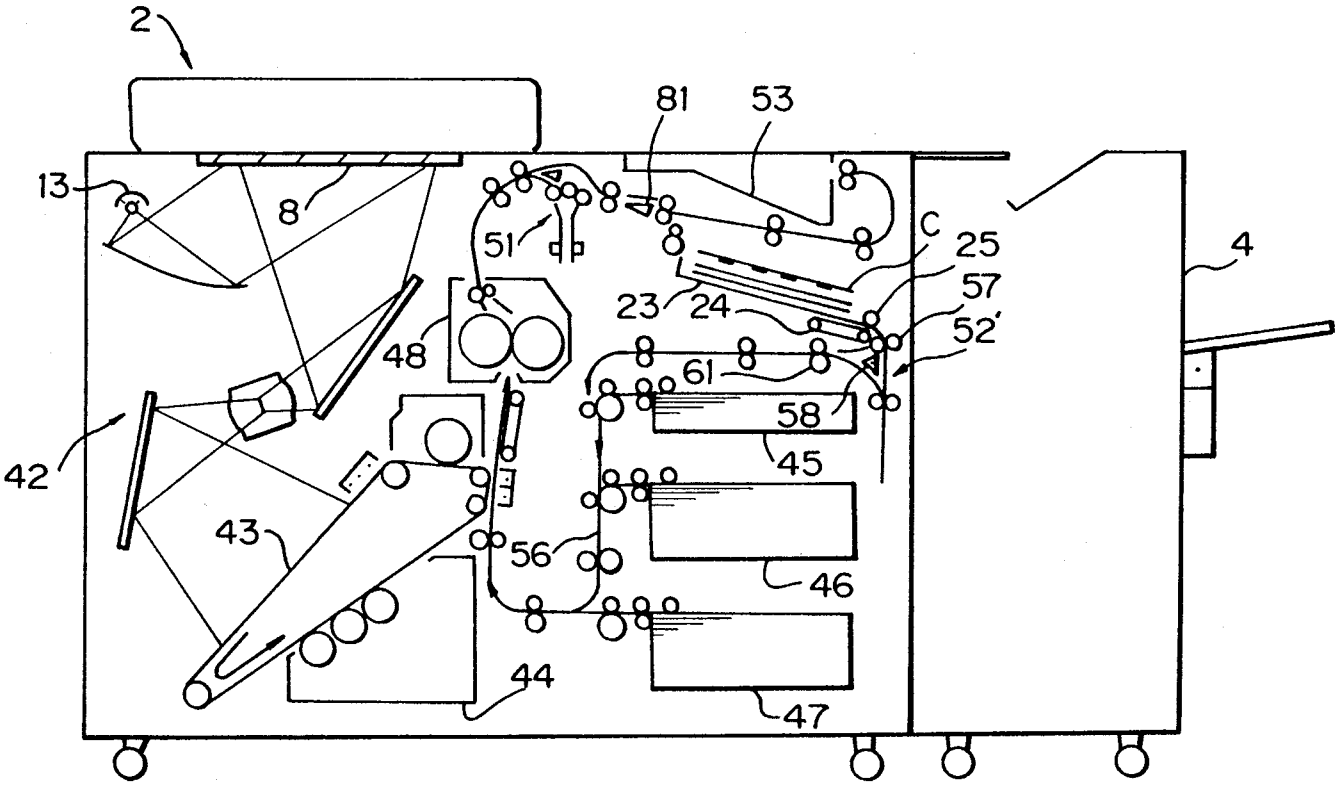
FIG. 7 is a view showing a third embodiment of the present invention.
Figure 8:
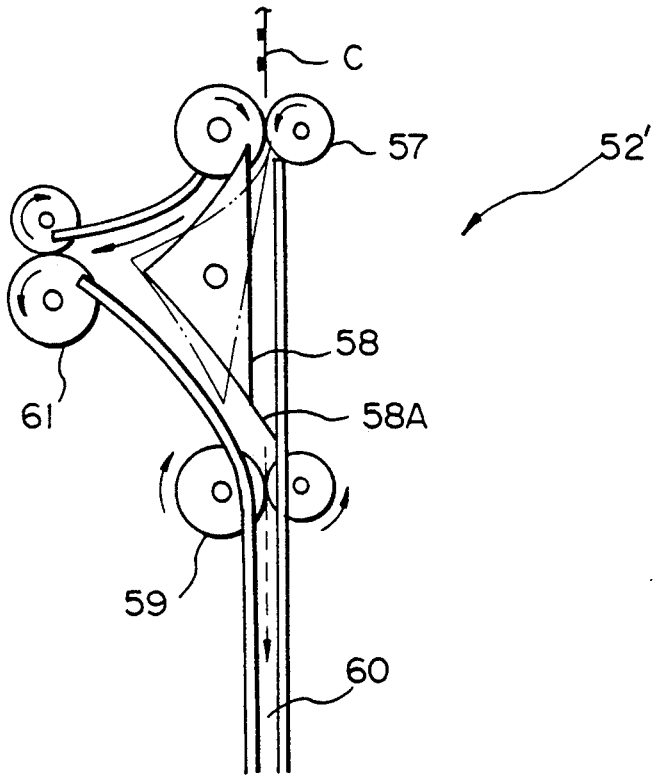
FIG. 8 is a view showing a second reversing device included in the third embodiment.

Referring to FIG. 7, a third embodiment of the present invention is shown which, like the second embodiment, has two reversing devices. In this embodiment, in both of a combination copy mode and a two-sided copy mode, all the one-sided copy sheets C are stacked on the intermediate tray 23 face down by way of the first reversing device 51, FIG. 5. A copy sheet C fully undergone any one of one-sided, two-sided and combination copy mode operations is driven out onto the tray 53. The copy sheets C stacked on the intermediate tray 23 are refed by the feeding device including the belt 24 and roller 25, the lowermost copy sheet being first, and then steered or not steered to a second reversing device 52'. As shown in FIG. 8, the second reversing device 52' has a path selecting device implemented as a pawl 58 and located below a transport roller pair 57.

In a combination copy mode, the selector or pawl 58 is held in a solid-line position for guiding the copy sheet C downward. An extremely thin elastic sheet 58A is affixed to the selector 58. The copy sheet C moves downward while urging the elastic sheet 58A slightly to the left. As soon as the trailing edge of the copy sheet C leaves the elastic sheet 58A, the rotation of a transport roller pair 59 located below the selector 58 is interrupted. In this condition, the copy sheet C is positioned in a reversing path 60 except for the upper or trailing edge portion thereof. Subsequently, the transport roller pair 59 is reversed to drive the copy sheet C upward toward a transport roller pair 61. In FIG. 7, the copy sheet C is transported face down to the image transfer station via the transport roller pair 61 and transport path 56. At the image transfer station, another toner image is transferred to the same side of the copy sheet C. The resultant copy carrying combined images on one side thereof is routed through the fixing device 48 to the tray 53. On the other hand, in a two-sided copy mode, the selector 58, FIG. 8, is brought to a phantom-line position to steer the copy sheet C coming out of the transport roller pair 57 in a direction indicated by a solid arrow in the figure. Then, the copy sheet C is routed through the transport roller pair 61 and the transport path, FIG. 7, to the image transfer station. As a result, a toner image is transferred from the belt 43 to the other side of the copy sheet C. The resultant two-sided copy is driven out onto a tray 53.

The second and third embodiments described above each has two reversing devices. The second embodiment shown in FIG. 4 refeeds a copy sheet C from the intermediate tray 23 by switching it back, while the third embodiment shown in FIG. 7 refeeds a copy sheet C in the same direction as the direction in which the copy sheet C enters the intermediate tray 23. The manner in which the third embodiment refeeds a copy sheet from the intermediate tray 23 will be referred to as forward feed hereinafter.

The selectors 55 and 58 shown in FIGS. 6 and 8, respectively, each is a specific form of path selecting means for causing the side of a copy sheet C opposite to the image side to face the photoconductive element in a two-sided copy mode or causing the image side to face the photoconductive element again in a combination copy mode. More specifically, the path selecting means guides a copy sheet C to the image transfer station by way of the second reversing means 52 or 52' in a two-sided copy mode or by-passing it in a combination copy mode.

Figure 9:
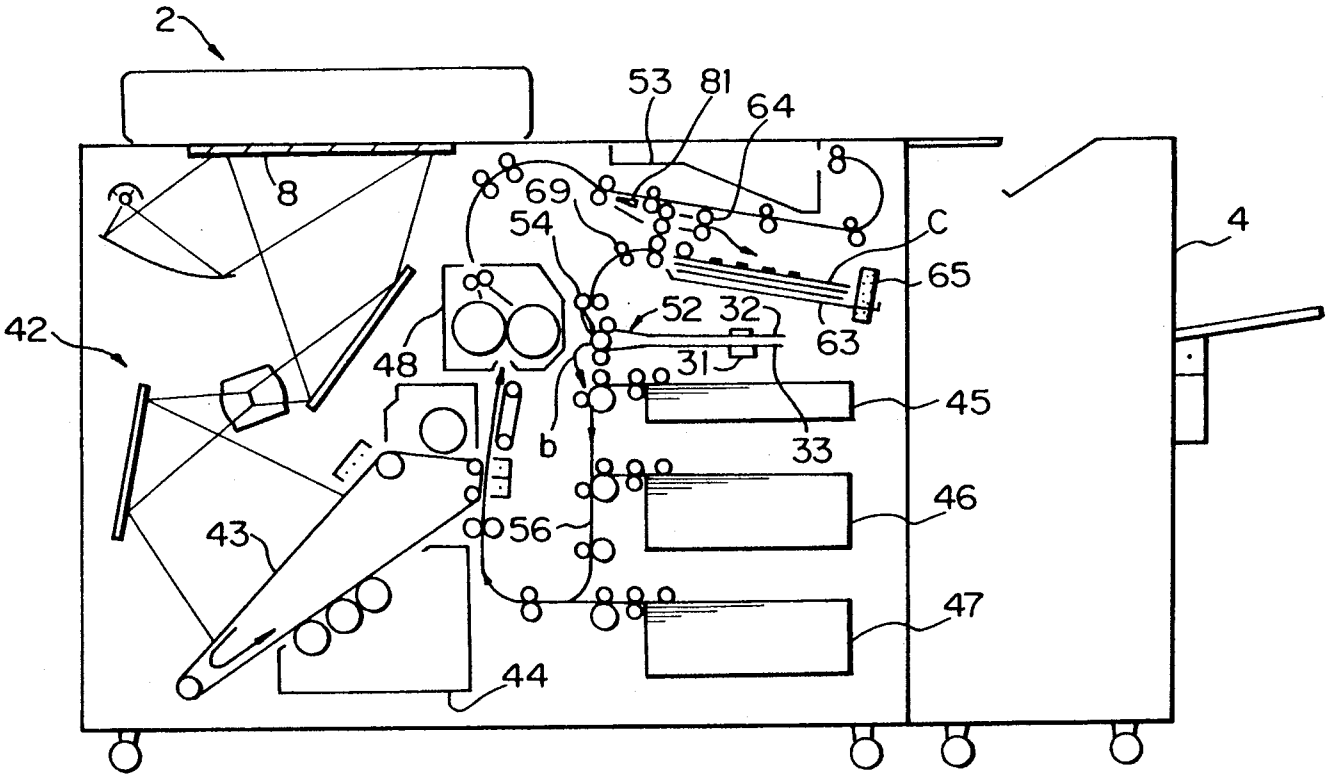
FIG. 9 is a view showing a fourth embodiment of the present invention.

FIG. 9 shows a fourth embodiment of the present invention. In this embodiment, a copy sheet C carrying a toner image on the first side thereof and come out of the fixing device 48 is stacked on an intermediate tray 63 face up. This manner of stacking is common to a combination copy mode and a two-sided copy mode. In a one-sided copy mode, the copy sheet C from the fixing device 48 is directly driven out onto the tray 53.

Figure 10:
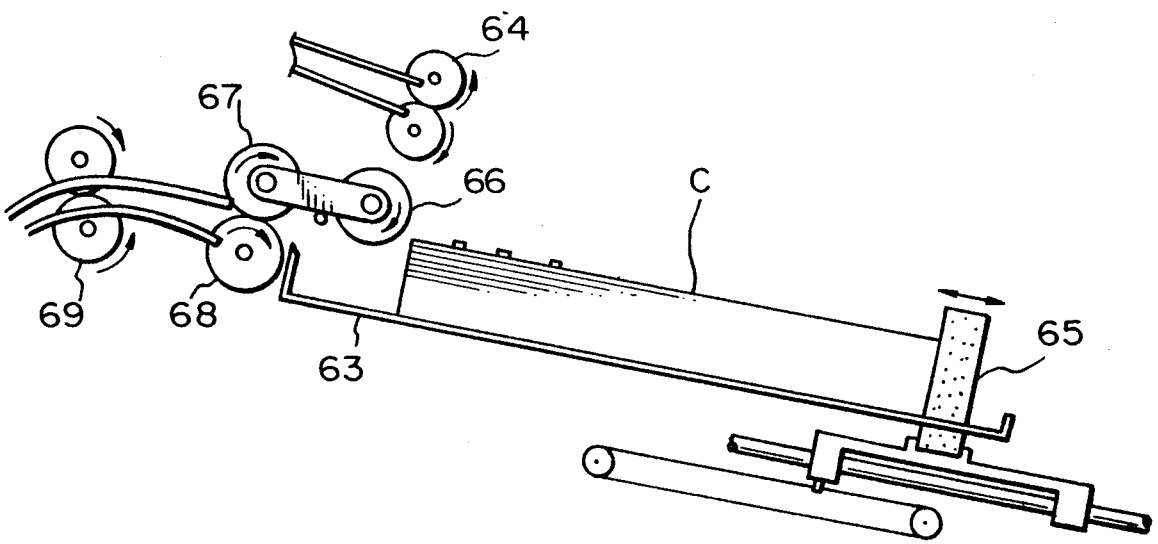
FIG. 10 is a view showing an intermediate tray included in the fourth embodiment.

FIG. 10 shows the intermediate tray 63 in detail. As shown, a copy sheet C moved away from a transport roller pair 64 is stacked on the intermediate tray 63 while abutting against a stop 65 made of sponge or similar soft elastic material. The stop 65, like the stop 31 of FIG. 3, is movable in a direction indicated by an arrow in the figure. Specifically, the stop 65 is driven to move the stack of copy sheets C to a position where it contacts a pick-up roller 66 which plays the role of a feeding device. The pick-up roller 66 feeds the uppermost copy sheet C to between a feed roller 67 and a separation roller 68. When two or more copy sheets C are picked up together, the rollers 67 and 68 cooperate to separate the uppermost copy sheet C from the others and drives it toward a transport roller 69. The transport roller 69 drives the copy sheet C toward the transport roller pair 54, FIG. 9. The rollers 67, 67 and 68 constitute a specific implementation for refeeding the copy sheets C one by one from the intermediate tray 63, the uppermost copy sheet being first. In a combination copy mode, the copy sheet C moved away from the transport roller pair 54 is routed through the reversing device 52 having the construction shown in FIG. 6. As a result, the copy sheet C enters the path between the guides 32 and 33 face down. Specifically, in FIG. 9, the copy sheet C is guided by the guides 32 and 33 in such a position in a direction indicated by an arrow b. When the copy sheet C reaches the image transfer station by way of the transport path 56, another toner image is transferred to the same surface of the copy sheet C. The resultant combination copy is discharged onto the tray 53 by way of the fixing device 48. In a two-sided copy mode, the copy sheet C refed from the intermediate tray 63 reaches the image transfer station via the transport path 56, by-passing the reversing device 52. After another toner image has been transferred from the belt 43 to the other side of the copy sheet C, the copy sheet C is drive out onto the tray 53 as a two-sided copy.

Figure 11:
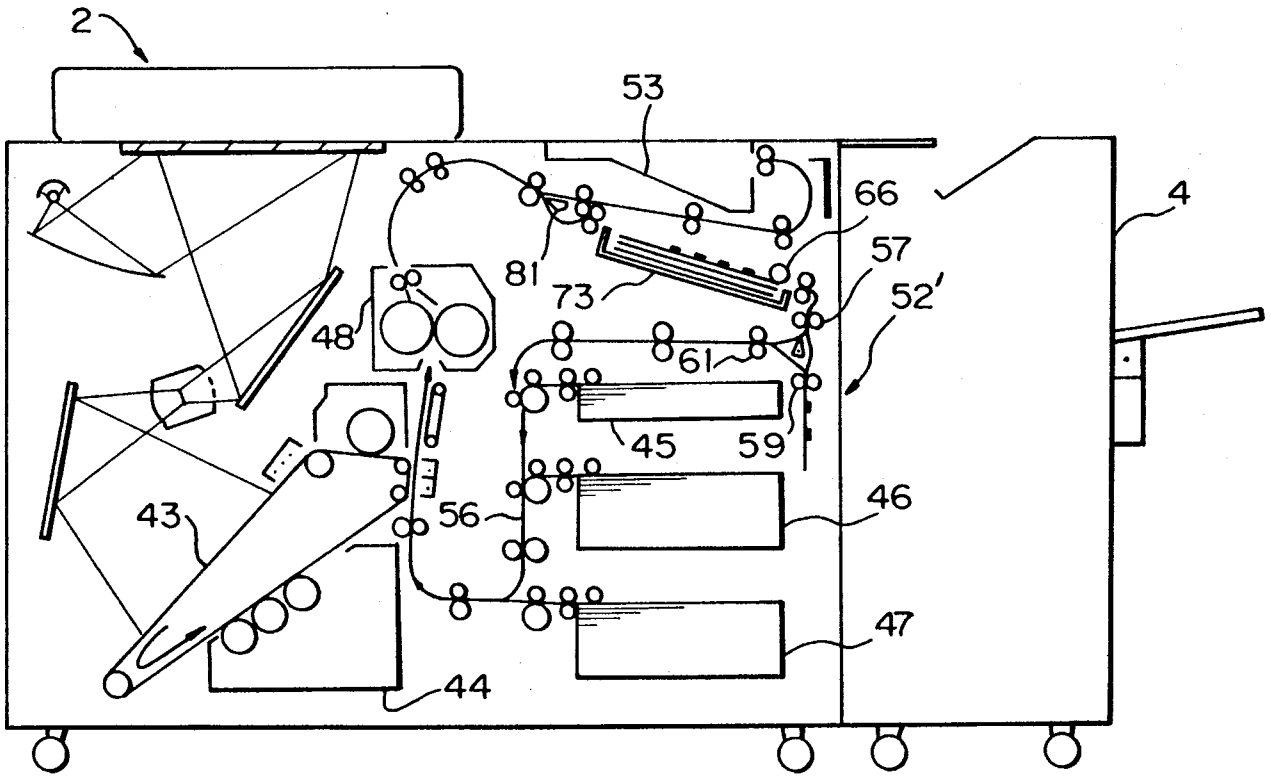
FIGS. 11, 12 and 13 are views showing respectively a fifth, a sixth and a seventh embodiment of the present invention.

Referring to FIG. 11, a fifth embodiment of the present invention which effects the previously mentioned forward feed, as distinguished from the switch-back type feed of the fourth embodiment. As shown, copy sheets C each carrying an image on the first side thereof are stacked on an intermediate tray 73 face up. In a two-sided copy mode, the pick-up roller or feeding device 66 refeeds the copy sheets C from the intermediate tray 73 toward the reversing device 52', the uppermost copy sheet being first. The reversing device 52' is constructed as shown in FIG. 8. In a two-sided copy mode, the copy sheet C from the tray 73 is guided into a reversing path 60. After being turned over, the copy sheet C is transported through a transport roller pair 61, FIG. 11, and then moved to the left face up. Thereafter, the copy sheet C is moved along the transport path 56 to the image transfer station for transferring another toner image to the other side thereof. The resultant two-sided copy is discharged to the tray 53. On the other hand, in a combination copy mode, the copy sheet from the intermediate tray 73 reaches the image transfer station via the transport path 56, by-passing the reversing device 52'. As a result, another toner image is transferred to the same side of the copy sheet C. This copy sheet or combination copy is driven out onto the tray 53. In a one-sided copy mode, the copy sheet C is directly moved to the tray 53 without the intermediary of the tray 73.

The embodiments shown in FIG. 9 and 11 both have a single reversing means, and each refeeds copy sheets C in a particular manner from the intermediate tray. In any case, the uppermost copy sheet C is refed first to reduce local contamination due to the toner.

Figure 12:
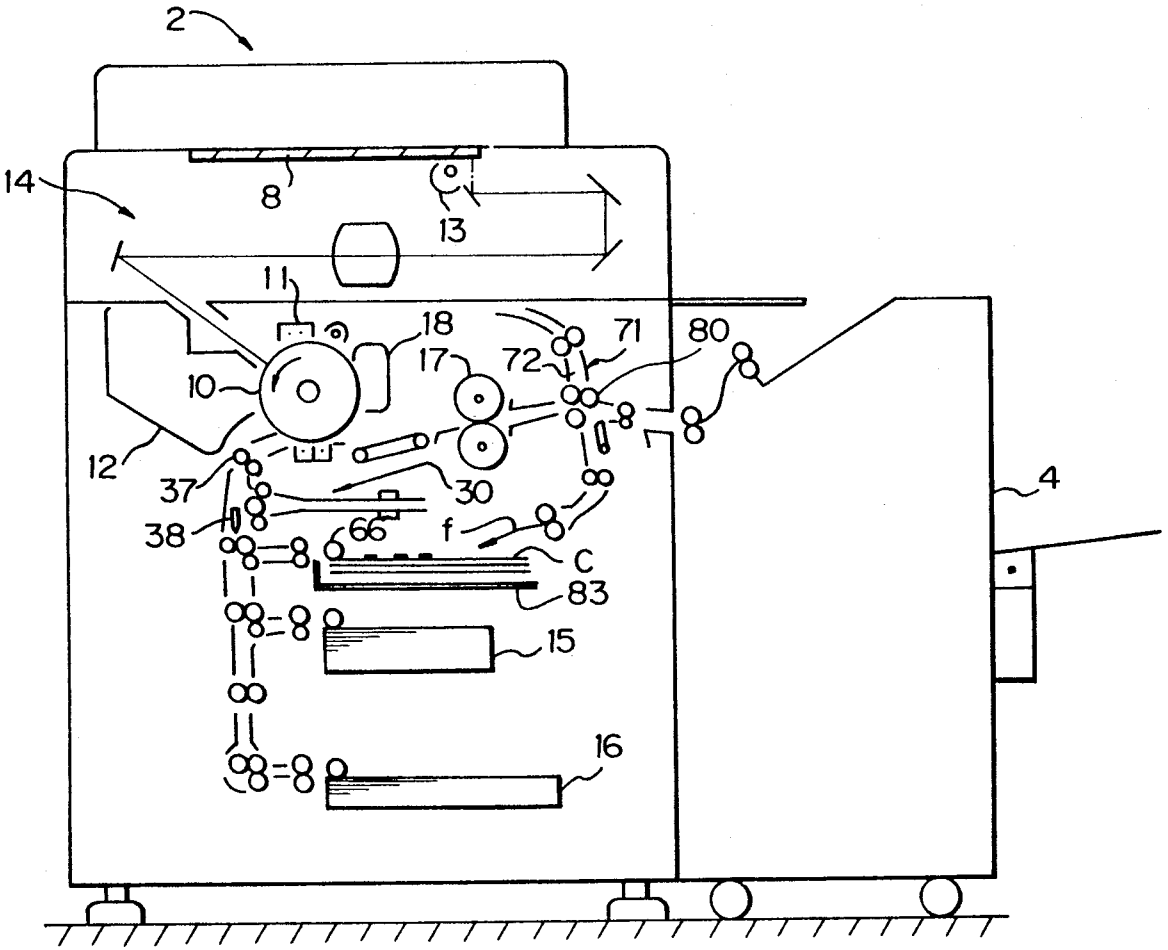

FIG. 12 shows a sixth embodiment of the present invention. In both of a combination copy mode and a two-sided copy mode, a copy sheet C carrying an image on one side thereof is transported face up to a first reversing device 71 by way of the fixing device 17. Comprising conventional three rollers 80, the first reversing device 71 steers the copy sheet C into a reversing path 72. The copy sheet C is turned over by the reversing device 71, moved downward, and then stacked on an intermediate tray 83 face up, as indicated by an arrow f. Subsequently, the pick-up roller or feeding device 66 feeds the uppermost copy sheet C from the intermediate tray 83. In a combination copy mode, the copy sheet C is directed toward the second reversing means 30, i.e., it enters the path between the guides 32 and 33, FIG. 3, face down. Then, the copy sheet C in such a position is routed through the rollers 34 and 36 and transport roller pair 37 to the photocondutive drum 10. As a result, another toner image is transferred from the drum 10 to the same side of the copy sheet C. The resultant combination copy is driven out to the finisher 4 or to a tray, not shown. In a two-sided copy mode, the selector 38 held in the solid-line position shown in FIG. 3 guides the copy sheet C from the intermediate tray 83 upward to the drum 10 without routing it through the reversing device 30. In this case, another toner image is transferred from the drum 10 to the other side of the copy sheet C. The resultant two-sided copy is directed toward the finisher 4 or to the tray, not shown. In a one-sided copy mode, the copy sheet C is directly driven out to the finisher 4 or the tray, by-passing the intermediate tray 83.

Figure 13:
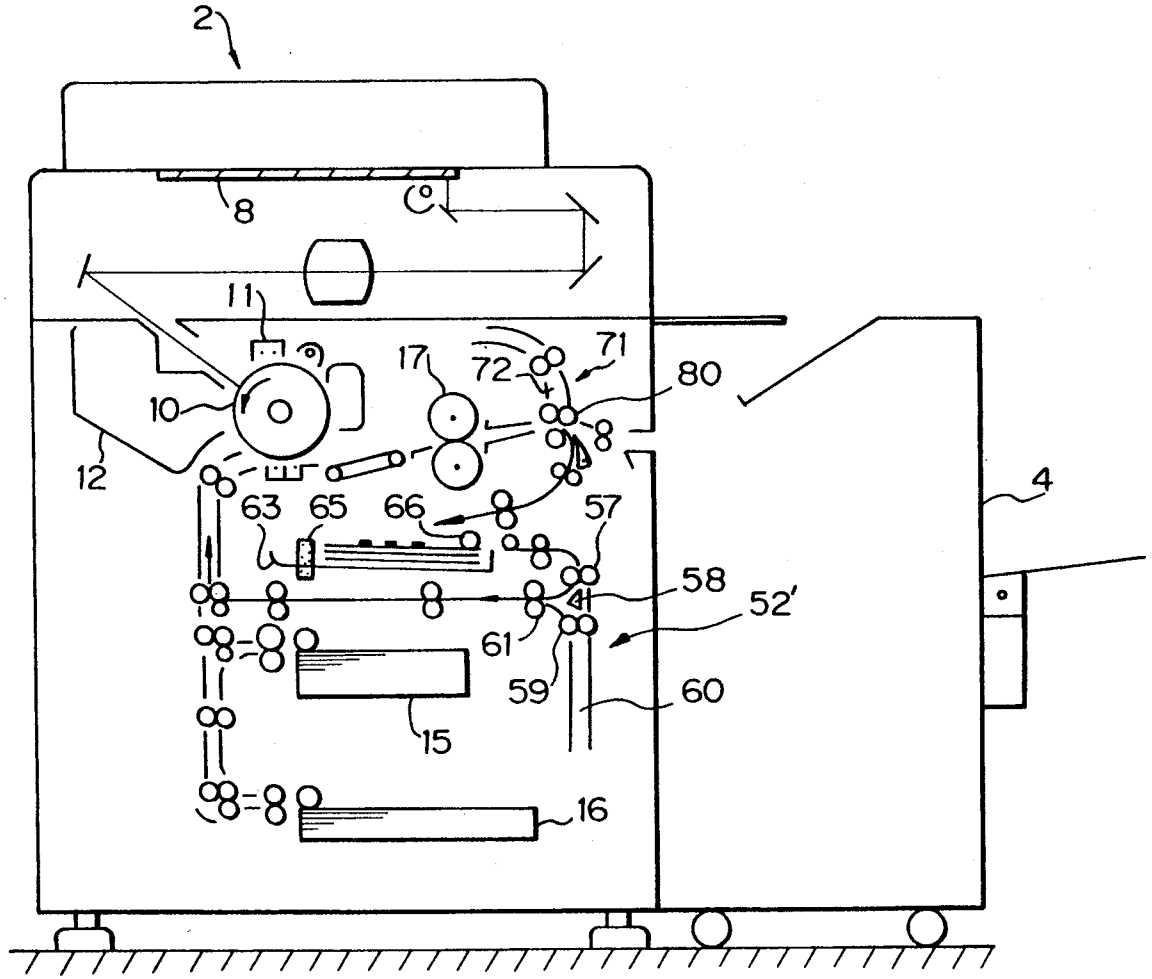

FIG. 13 shows a seventh embodiment of the present invention which effects the switch-back feed, as distinguished from the forward feed of the embodiment of FIG. 6. In both of a combination copy mode and a two-sided copy mode, a copy sheet C undergone the first image transfer enters the reversing path 72 of the first reversing device 71. After being turned over by the device 71, the copy sheet C is stacked on the intermediate tray 63 face up. After the copy sheets C have been shifted by the stop 65 to the right as viewed in the figure, they are fed by the pick-up roller 66 one by one to the transport roller pair 57. In a two-sided copy mode, the copy sheet C from the roller pair 57 enters the reversing path 60 while having the edge thereof nipped by the roller pair 59. The selector 58 switched to the solid-line position shown in FIG. 8 guides such a copy sheet C to the roller pair 61, FIG. 13. The roller pair 61 drives the copy sheet C which is positioned face up to the left. At the image transfer position where the drum 10 is located, a toner image is transferred from the drum 10 to the other side of the copy sheet C. The resultant two-sided copy is routed through the fixing device 17 to the finisher 4 or to the tray, not shown. In a combination copy mode, the copy sheet C is transported by the roller pairs 57 and 61, by-passing the second reversing device 52'. In this case, a toner image is transferred from the drum 10 to the same side of the copy sheet C. Then, the copy sheet or combination copy C is driven out to the finisher or the tray by way of the fixing device 17. In a one-sided copy mode, the copy sheet C is discharged without the intermediary of the intermediate tray 63.

This embodiment, like the embodiment shown in FIG. 12, has two reversing devices and refeeds copy sheets C face up from the intermediate tray 63, the uppermost copy sheet being first. Hence, the embodiment allows a minimum of local contamination due to the toner to occur.

It is to be noted that stacking copy sheets face up is successful in miniaturizing the structure and enhancing free layout.

In summary, it will be seen that the present invention provides a copier which implements both of two-sided copying and combination copying without causing local smearing by a toner. Further, the copier of the present invention is miniature and inexpensive since it does not need a plurality of intermediate trays.

Various modifications will become possible for those skilled in the art after receiving the teachings of the present disclosure without departing from the scope thereof.

What is claimed:

1. A copier operable in a two-sided copy mode and a combination copy mode, comprising:

an intermediate tray for stacking copy sheets sequentially moved away from an image forming station;

feeding means for feeding only the topmost of said copy sheets one by one from said intermediate tray by frictionally contacting an image side of each of said copy sheets which carries an image thereon, said copier lacking means for feeding the bottommost of said copy sheets; and transporting means including reversing means for transporting each of said copy sheets fed by said feeding means such that in a two-sided copy mode the side of said copy sheet opposite to said image side faces said image forming station while, in a combination copy mode, said image side faces said image forming station.

2. A copier operable in a two-sided copy mode and a combination copy mode, comprising:

an intermediate tray for stacking copy sheets sequentially moved away from an image forming station and each being position such that an image side thereof which carries an image faces downward;

feeding means for feeding only the bottommost of said copy sheets one by one from said intermediate tray, said copier lacking means for feeding the topmost of said copy sheets;

reversing means for turning over each of said copy sheets fed by said feeding means and then driving said copy sheet toward said image forming station; and path selecting means for guiding each of said copy sheets to said reversing means in a two-sided copy mode or directly to said image forming station in a combination copy mode.

3. A copier operable in a two-sided copy mode and a combination copy mode, comprising:

first reversing means for turning over each of copy sheets sequentially moved away from an image forming station;

an intermediate tray for stacking said copy sheets moved away from said first reversing means and each being positioned such that an image side thereof which carries an image faces downward;

feeding means for sequentially feeding said copy sheets stacked on said intermediate tray, the lowermost copy sheet being first;

second reversing means for turning over each of said copy sheets fed by said feeding means and then driving said copy sheet toward said image forming station; and path selecting means for guiding, in a two-sided copy mode, each of said copy sheets toward said image forming station via said second reversing means such that the side of said copy sheet opposite to said image side faces said image forming station or guiding, in a combination copy mode, said copy sheet directly toward said image forming station without the intermediary of said second reversing means such that said image side of said copy sheet faces said image forming station.

4. A copier operable in a two-sided copy mode and a combination copy mode, comprising:

an intermediate tray for stacking copy sheets sequentially moved away from an image forming station and each being positioned such that an image side thereof which carries an image faces upward;

feeding means for sequentially feeding only the topmost of said copy sheets stacked in said intermediate tray, said copier lacking means for feeding the bottommost of said copy sheets;

reversing means for turning over each of said copy sheets fed by said feeding means and then driving said copy sheet toward said image forming station; and path selecting means for guiding, in a two-sided copy mode, said copy sheets toward said image forming station via said reversing means such that the side of each of said copy sheets opposite to said image side faces said image forming station or guiding, in a combination copy mode, said copy sheets directly to said image forming station without the intermediary of said reversing means such that said image side faces said image forming station.

5. A copier operable in a two-sided copy mode and a combination copy mode, comprising:

first reversing means for turning over copy sheets sequentially moved away from an image forming station;

an intermediate tray for stacking said copy sheets moved away from said first reversing means and each being positioned such that an image side thereof which carries an image faces upward;

feeding means for sequentially feeding said copy sheets stacked on said intermediate tray, the uppermost copy sheet being first;

second reversing means for turning over each of said copy sheets fed by said feeding means and then driving said copy sheet toward said image forming station; and path selecting means for guiding, in a two-sided copy mode, each of said copy sheets toward said image forming station via said second reversing means such that the side of said copy sheet opposite to said image side faces said image forming station or guiding, in a combination copy mode, said copy sheet directly toward said image forming station without the intermediary of said second reversing means such that said image side faces said image forming station.

6. A copier operable in a two-sided copy mode and a combination copy mode, comprising:

an intermediate tray for stacking copy sheets sequentially moved away from an image forming station;

feeding means for feeding only the bottommost of said copy sheets one by one from said intermediate tray by frictionally contacting an image side of each of said copy sheets which carries an image thereon, said copier lacking means for feeding the topmost of said copy sheets; and transporting means including reversing means for transporting each of said copy sheets fed by said feeding means such that in a two-sided copy mode the side of said copy sheet opposite to said image side faces said image forming station while, in a combination copy mode, said image side faces said image forming station.

7. A copier operable in a two-sided copy mode and a combination copy mode, comprising:

an intermediate tray for stacking copy sheets sequentially moved away from an image forming station and all being positioned such that image sides thereof which carry images face upward or downward;

feeding means for feeding said copy sheets one by one from said intermediate tray by frictionally contacting an image side of each of said copy sheets which carries an image thereon in each of a two-sided copy mode and a combination copy mode; and transporting means for transporting each of said copy sheets fed by said feeding means toward said image forming station while selectively turning over each of said copy sheets such that in the two-sided copy mode the side of the copy sheet opposite to said image side faces said image forming station while, in the combination copy mode said image side faces said image forming station.

8. A copier operable in a two-sided copy mode and a combination copy mode, comprising:

an intermediate tray for stacking copy sheets sequentially moved away from an image forming station and all being positioned such that image sides thereof which carry images face downward;

feeding means for feeding only the bottommost of said copy sheets one by one from said intermediate tray in each of a two-sided copy mode and a combination copy mode; and transporting means for transporting each of said copy sheets fed by said feeding means toward said image forming station while selectively turning over each of said copy sheets such that in the two-sided copy mode the side of said copy sheets opposite to said image side faces said image forming station while, in the combination copy mode said image side faces said image forming station.

9. A copier operable in a two-sided copy mode and a combination copy mode, comprising:

first reversing means for turning over each of copy sheets sequentially moved away from an image forming station;

an intermediate tray for stacking said copy sheets moved away from said first reversing means and all being positioned such that image sides thereof which carry images face downward;

feeding means for sequentially feeding only the bottommost of said copy sheets stacked on said intermediate tray in each of a two-sided copy mode and a combination copy mode; and second reversing means for selectively turning over each of said copy sheets fed by said feeding means and transported from said intermediated tray toward said image forming station such that in the two-sided copy mode the side of said copy sheet opposite to said image side faces said image forming station while, in the combination copy mode said image side of said copy sheet faces said image forming station.

10. A copier operable in a two-sided copy mode and a combination copy mode, comprising:

an intermediate tray for stacking copy sheets sequentially moved away from an image forming station and all being positioned such that image sides thereof which carry images face upward;

feeding means for sequentially feeding only the topmost of said copy sheets stacked on said intermediate tray in each of a two-sided copy mode and a combination copy mode; and reversing means for selectively turning over each of said copy sheets fed by said feeding means and transported from said intermediate tray toward said image forming station such that in the two-sided copy mode the side of each of said copy sheets opposite to said image side faces said image forming station while, in the combination copy mode said image side faces said image forming station.

11. A copier operable in a two-sided copy mode and a combination copy mode, comprising:

first reversing means for turning over copy sheets sequentially moved away from an image forming station;

an intermediate tray for stacking said copy sheets moved away from said first reversing means and all being positioned such that image sides thereof which carry images face upward;

feeding means for sequentially feeding only the topmost to said copy sheets stacked on said intermediate tray in each of a two-sided copy mode and a combination copy mode; and second reversing means for selectively turning over each of said copy sheets fed by said feeding means and transported from said intermediate tray toward said image forming station such that in the two-sided copy mode the side of said copy sheet opposite to said image side faces said image forming station while, in the combination copy mode said image side faces said image forming station.

* * * * *